United States Patent [19]

Rix

[11] 4,200,402

[45] Apr. 29, 1980

[54] CARRIAGE GUIDE FOR TYPING ELEMENT CARRIER

[75] Inventor: Albert Rix, Wilhelmshaven, Fed. Rep. of Germany

[73] Assignee: Olympia Werke AG, Wilhelmshaven, Fed. Rep. of Germany

[21] Appl. No.: 936,137

[22] Filed: Aug. 23, 1978

[30] Foreign Application Priority Data

Aug. 26, 1977 [DE] Fed. Rep. of Germany ..... 2738496

[51] Int. Cl.[2] ..... B41J 25/30

[52] U.S. Cl. ..... 400/354.1; 400/320

[58] Field of Search ..... 400/59, 320, 328, 352, 400/354, 354.1–354.3; 308/6 R, 3 CH

[56] References Cited

U.S. PATENT DOCUMENTS

| | | | |
|---|---|---|---|
| 2,051,041 | 8/1936 | Helmond | 400/354.3 |
| 2,253,820 | 8/1941 | Spiro | 308/6 R X |
| 3,960,256 | 6/1976 | Bickoff et al. | 400/59 X |
| 4,086,997 | 5/1978 | Wu | 400/59 X |
| 4,134,695 | 1/1979 | Randolph | 400/59 X |

FOREIGN PATENT DOCUMENTS

| | | | |
|---|---|---|---|
| 2159647 | 6/1972 | Fed. Rep. of Germany | 400/161 |
| 1817850 | 6/1973 | Fed. Rep. of Germany | 400/124 |
| 266657 | 7/1970 | U.S.S.R. | 400/354.2 |

OTHER PUBLICATIONS

IBM Tech. Disc. Bulletin, "Carrier Support Device," L. P. Bernard et al., vol. 20, No. 2, Jul. 1977, pp. 567–568.

IBM Tech. Disc. Bulletin, "Carriage Guide System," W. E. Beuch et al., vol. 20, No. 12, May 1978, pp. 5265–5266.

*Primary Examiner*—Paul T. Sewell

*Attorney, Agent, or Firm*—Spencer & Kaye

[57] ABSTRACT

A carriage guide for supporting a typing element carrier and composed of two guide rails extending parallel to a printing abutment, and pairs of guide rollers mounted on intersecting axes and connected with the typing element carrier for centering the typing element carrier at at least one of the guide rails, is further provided with first and second roller carriers carrying the guide rollers at sides thereof extending parallel to the rails, the roller carriers being disposed to intersect one another and the second roller carrier being provided with a slide edge, elements defining a common joint extending between, and parallel to, the guide rails and via which the carriers bear against one another, a tensioning spring element acting between the roller carriers, a receiving element carried by the first roller carrier at one of its sides parallel to the rails for establishing an articulated connection with the typing element carrier, and a supporting spring element cooperating with the slide edge for effecting a force-locking effective connection between the second roller carrier and the typing element carrier.

9 Claims, 2 Drawing Figures

CARRIAGE GUIDE FOR TYPING ELEMENT CARRIER

BACKGROUND OF THE INVENTION

The present invention is directed to a carriage guide, particularly for typing element carriers for office machines, of the type composed of two guide rails extending parallel to a printing abutment and pairs of guide rollers mounted on an intersecting axis and connected with the typing element carrier, the typing element carrier centering itself by means of the guide rollers at one or both of the guide rails.

Carriage guides essentially constituted by guide rollers connected with a typing element carrier and guide rails provided in a machine frame are generally known in the art. In the development of such carriage guides it has been found that problems requiring special measures for their solution occur with regard to office machines in which the elements carrying the character types or the elements forming the characters are arranged, even in the rest position, very close to the printing abutment, as is true, in particular for the so-called mosaic printers, i.e. wire element or ink printers, or where the stepping movements of the typing element carrier occur at high operating speeds and are produced by relatively sensitive devices such as, for example, stepping motors or controlled d.c. motors.

For example, measures must be provided to assure that the carriage moves relatively smoothly, i.e. very uniformly, even if the relatively long guide rails are not absolutely precisely parallel and straight with respect to one another or if there is dirt, such as eraser shavings for example, on these guides.

To avoid problems of this type, it has been proposed to give pairs of axially parallel guide rollers a V-belt shape and to move them on guide rails having a circular cross section, one of the guide rollers being fastened directly and the other guide roller indirectly via a pivotal lever arm which is continuously under the influence of a spring, as disclosed in German Offenlegungsschrift No. 2,159,647. With this arrangement it is possible to avoid occasionally occurring slowdowns in the movement of the carriage guide since one of the guide rollers is yieldably supported.

But this arrangement still has the drawback that the typing element carrier is mounted without play in only one direction, i.e. in the tensioning direction of the yielding guide roller, since it is practically impossible to manufacture the guide rollers and their bearing shafts precisely enough, at commercially justifiable cost, so that they move without play in their axial direction. However, in some printers, e.g. ink printers, such bearing play can already have a damaging effect with respect to quality of the printed end product. Also, such play between parts can produce humming noises in the entire incremental drive system for the typing element carrier, which noises have a particularly annoying effect if the carriage movement has been made almost noiseless by, for example, stepping motor drives and if printing itself is also noiseless, as for example if it is effected by an ink jet method.

Other carriage guides composed of three guide rollers cooperating with one of the guide rails so as to enclose the same in the form of a star, with one of the rollers being resiliently mounted, overcome the above-noted drawback, but have the other drawback that the carriage can be mounted on or removed from the guide rails only under difficult conditions. In other words, the carriage can be mounted onto the machine frame practically only together with the guide rails.

A further known carriage guide, disclosed in German Offenlegunggschrift No. 1,817,850, has a prismatic guide rail on which two crossed pivot bearings move on guide rollers provided on the carriage. A further roller is mounted on a perpendicular shaft to follow a horizontal effective curve which cooperates with these guide rollers and with a second guide rail having a circular cross section to bring the carriage into contact with the first guide rail in that the second guide rail is mounted to be pivotal parallel to the first rail about a pivot bearing and is always under the influence of a spring. Thus the carriage can be placed onto the guide rails or removed therefrom at any point since the second guide rail can be pivoted out of an associated guide fork of the carriage. This construction however again requires very precise manufacture of the individual parts in order to prevent clatter. Between the guide fork and the guide rail there may again develop dirt accumulations which can lead to occasional heavy movement of the carriage guide.

SUMMARY OF THE INVENTION

It is an object of the present invention to provide a carriage guide for a typing element carrier which is insensitive to dirt on the guide rails, operates without play and in which the typing element carrier can easily be removed from the guide rails and replaced thereon.

These and other objects are achieved, according to the invention, by the provision, in a carriage guide for supporting a typing element carrier and composed of two guide rails extending parallel to a printing abutment, and pairs of guide rollers mounted on intersecting axes and connected with the typing element carrier for centering the typing element carrier at at least one of the guide rails, of first and second roller carriers carrying the guide rollers at sides thereof extending parallel to the rails, the roller carriers being disposed to intersect one another, means defining a common joint extending between, and parallel to, the guide rails and via which the roller carriers bear against one another, tensioning spring means acting between the roller carriers, the first roller carrier being provided at one of its sides parallel to the rails with receiving means for establishing an articulated connection with the typing element carrier, and the second roller carrier being provided with a slide edge for effecting a force-locking effective connection between the second roller carrier and the typing element carrier through the influence of the spring means.

The carriage guide structure according to the present invention produces the significant effect, in addition to the advantages evident from the above statement of objectives, that the individual parts of the entire carriage, which are in relatively loose effective connection with one another, can yield to one another in such a manner that the typing element carrier can yield with respect to the guide rails practically in every conceivable direction against the automatic detent action of the shear system, so that sensitive parts which are fastened to the typing element carrier, such as, for example, an ink ejection head, will not be damaged due to inadvertent sudden impacts as a result of actions by an operator.

DESCRIPTION OF THE PREFERRED EMBODIMENTS

Figure 1:
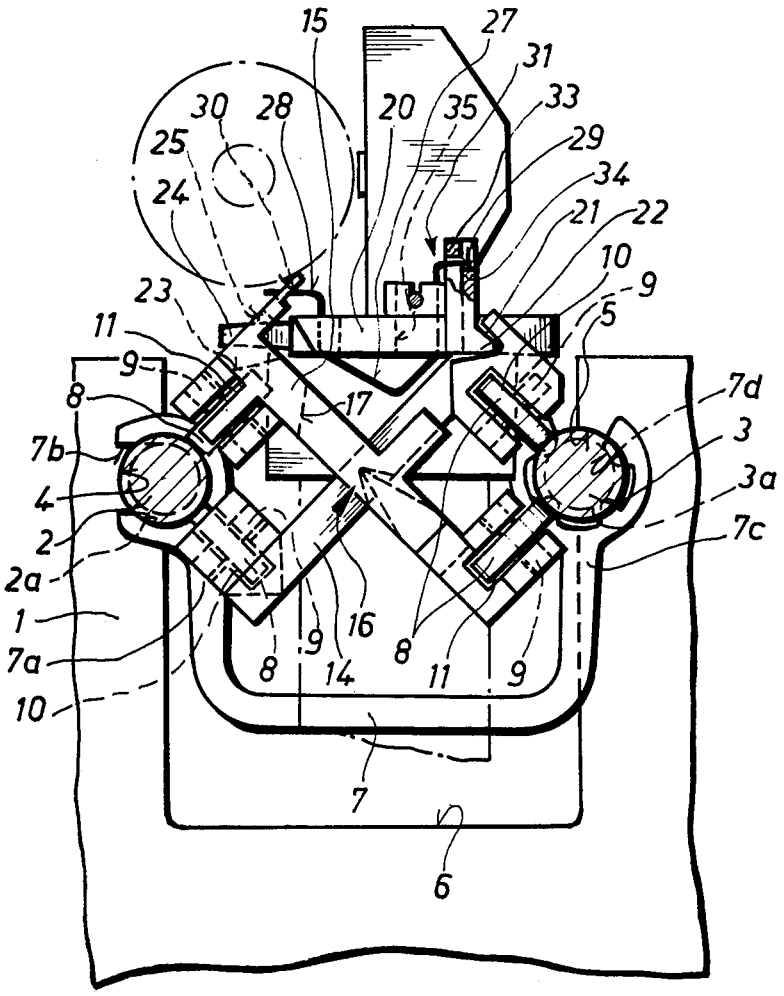
FIG. 1 is a side elevational view of a preferred embodiment of a carriage guide according to the invention.

FIG. 1 illustrates a carriage guide having two guide rails 2 and 3 mounted in a machine frame 1. Each guide rail has a circular cross section and is inserted into a respective one of the semicircular bearing depressions 4 and 5 formed in the machine frame 1. The bearing depressions 4 and 5 are provided in mutually parallel edges of recesses 6 in the side walls of the machine frame 1. The guide rails 2 and 3 are held in these bearing depressions 4 and 5 by spreading springs 7, one such spring being located at each end of rails 2 and 3. The spreading springs 7 are made of planar bar springs cut out of sheet metal and provided at one end 7*a* with an open jaw 7*b* which has parallel insertion edges extending in its effective direction and which engages in an annular groove 2*a* of the guide rail 2, and at its other end 7*c* with a jaw 7*d* in the form of a safety disc, or Benzing disc, whose insertion opening is arranged transverse to the effective direction and which can be inserted to be arrested in an annular groove 3*a* of the other guide rail 3 by a pivoting movement of the entire spreading spring 7.

Figure 2:
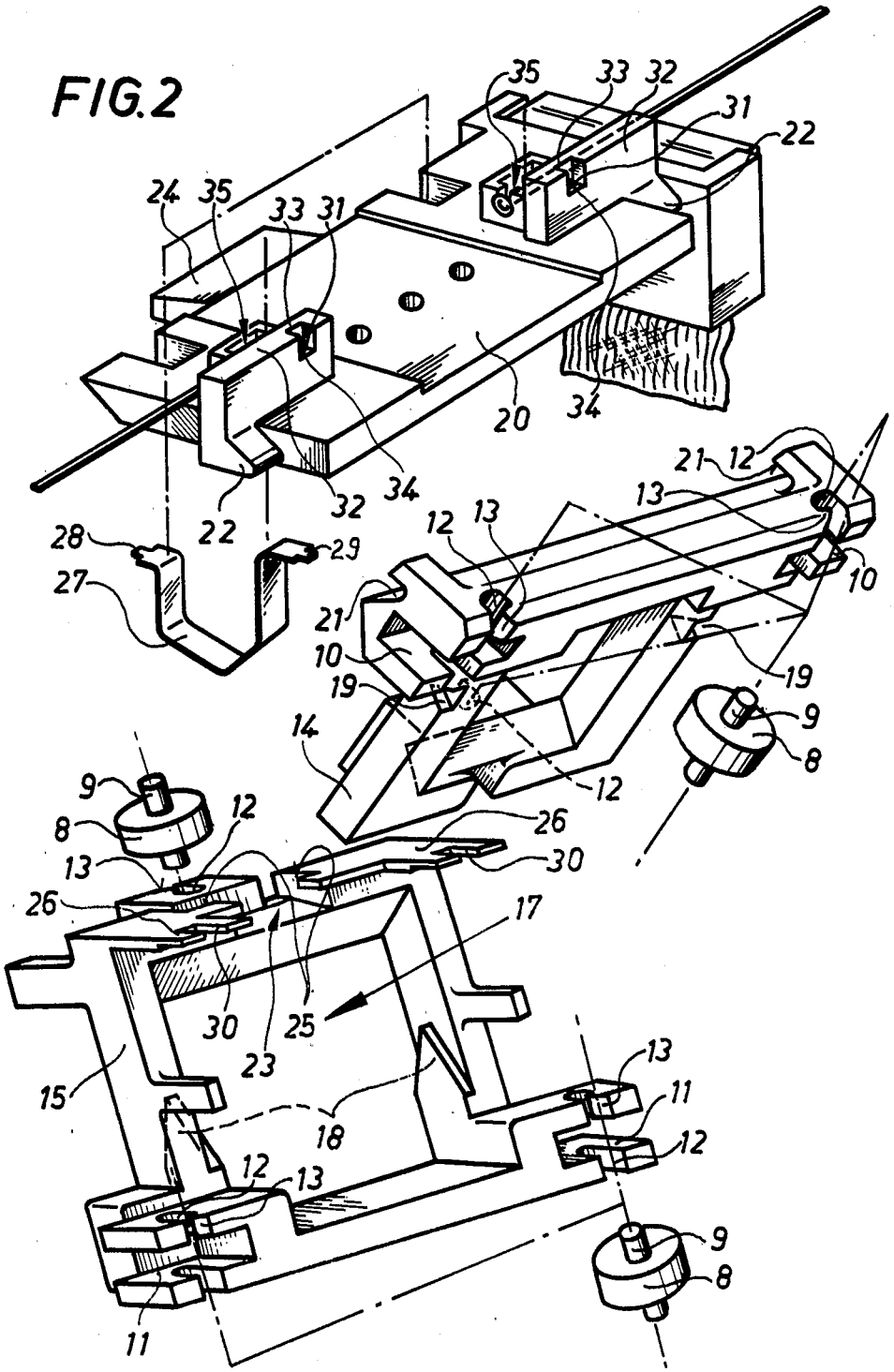
FIG. 2 is an exploded perspective view of the embodiment of FIG. 1.

A plurality of guide rollers 8, each rotatably mounted on a respective fixed shaft journal 9, engage guide rails 2 and 3. These guide rollers 8 can be inserted into slots 10 and 11 while their journals are held in lateral bearing depressions 12 adjacent the slots. For retaining the bearings in place, the bearing depressions 12 are each provided with a detent tongue 13 which prevents the guide rollers 8 from falling out of the slots 10 and 11 as best seen in FIG. 2.

The slots 10 and 11 for the guide rollers 8 are provided in first and second roller carriers 14 and 15, respectively, made of plastic parts which telescope in one another and which can be articulated to one another via a joint 16. Second roller carrier 15 in particular is given a frame-like configuration such that a rectangular opening 17 is formed to receive the first roller carrier 14. Wedge-shaped bearing protrusions 18 are provided at those inner faces of the opening 17 which face in, or are perpendicular to, the direction of movement of the carriage. In the mounted state, bearing protrusions 18 engage in V-shaped bearing depressions 19 which are provided in outer side faces of the first bearing carrier 14.

The bearing protrusions 18 and the bearing depressions 19 are provided at the associated roller carriers 14 and 15, respectively, at such locations that the joint 16 formed by these elements is disposed between the guide rails 2 and 3 on an axis extending parallel to the axes of those guide rails. The roller carriers 14 and 15, which can thus be brought into scissors-like interaction, are each provided with lever arms of substantially equal length and the guide rollers 8 are disposed at the ends of these arms in such a manner that they can rest on guide rails 2 and 3 with the bearing faces of the rollers 8 on one carrier offset by 90° from those of the rollers on the other carrier. Two rollers are provided at the side of each of the roller carriers located to the right in FIG. 1 and only one roller is provided at each of their sides located to the left.

The side of the first roller carrier 14 which faces toward the upper right in FIG. 1 is provided with V-shaped bearing depressions 21 at its ends facing in the directions of movement of the carriage, which depressions constitute a receptacle for one side of a typing element carrier 20 and into which wedge-shaped bearing protrusions 22 of the latter can be inserted. The bearing depressions 21 and the bearing protrusions 22 are designed so that plug-in assembly of the typing element carrier 20 with the roller carrier 14 must be effected from the left to the right with respect to the view of FIG. 1.

The wedge-shaped bearing protrusions 22 are given a more acute angle than the bearing depressions 21 so that pivotal movement is possible between the roller carrier 14 and the typing element carrier 20 as well as between the two roller carriers themselves.

The second roller carrier 15 is provided, at its side facing toward the upper left, with a guide opening or recess 23 into which a supporting tongue 24 of the typing element carrier 20 can be inserted transverse to the direction of movement of the carriage. This guide opening 23 is limited toward the top by slide edges 25 formed by lateral protrusions of two supporting arms 26 which are part of the second roller carrier 15. Arms 26 extend upwardly and thus form extended lever arms.

A respective spring 27 engages at each one of these supporting lever arms 26. Springs 27 are essentially U-shaped leaf springs with detent tongues 28 and 29 extending from their free ends at right angles thereto. The detent tongues 28 of springs 27 engage in detent recesses 30 provided at the free ends of supporting arms 26.

With their other detent tongues 29, springs 27 engage in detent recesses 31 which are provided at the free ends of lever arms 32 of roller carrier 20. Lever arms 32 protrude from the plane of the typing element carrier 20 in an upward direction and at a right angle to that plane so that the typing element carrier 20 is pushed with its bearing protrusions 22 into bearing depressions 21 of the first roller carrier 14 and is urged by the resulting bearing forces in a clockwise direction in such a way that supporting tongue 24 can be brought into a force-locking abutment association with the slide edges 25 of the second roller carrier 15.

As can be seen particularly in FIG. 1, the detent recesses 31 are formed by mutually laterally offset bars 33 and 34 of the lever arm 32 of the typing element carrier 20, which has been produced in a plastic ejection molding process. These bars 33 and 34 are disposed at one of the interior walls of each of passage openings 35 and each spring 27 is pushed through a respective opening 35.

Thus springs 27, on the one hand, directly engage the second roller carrier 15, in recesses 30, and, on the other hand, via lever arms 32 of the typing element carrier 20, indirectly engage the first roller carrier 14. As a result, the springs 27 simultaneously act as tensioning springs for the roller carriers 14 and 15 and as supporting springs for the typing element carrier 20. Due to the fact that the two roller carriers 14 and 15 are continuously subjected to the clamping effect of springs 27, they can center themselves without play at the guide rails 2 and 3 for establishing a horizontal orientation of the typing element carrier 20.

Possible manufacturing inaccuracies in the spacing of guide rails 2 and 3 relative to each other, which could produce a mutual angular displacement between the roller carriers 14 and 15, can have no influence on the typing element carrier 20 since it is only force-lockingly supported by its supporting tongue 24 at the slide edges 25, which permits compensatory movement without play between the parts involved. Due to the relatively loose connection of the essential operating parts of the entire carriage with respect to one another, the carriage is able to yield in every direction and thus protect sensitive components if it should be subjected to inadvertent impacts.

It will be understood that the above description of the present invention is susceptible to various modifications, changes and adaptations, and the same are intended to be comprehended within the meaning and range of equivalents of the appended claims.

What is claimed is:

1. In a carriage guide for supporting a typing element carrier and composed of two guide rails extending parallel to a printing abutment, and pairs of guide rollers mounted on intersecting axes and connected with the typing element carrier for centering the typing element carrier at at least one of the guide rails, the improvement comprising first and second roller carriers carrying said guide rollers at sides thereof extending parallel to said rails, said roller carriers being disposed to intersect one another and said second roller carrier being provided with a slide edge; means defining a common joint extending between, and parallel to, said guide rails and via which said carriers bear against one another; tensioning spring means acting between said roller carriers; receiving means carried by said first roller carrier at one of its sides parallel to said rails for establishing an articulated connection with said typing element carrier; and supporting spring means cooperating with said slide edge for effecting a force-locking effective connection between said second roller carrier and said typing element carrier.

2. An arrangement as defined in claim 1 wherein: said means defining a common joint are composed of two V-shaped bearing depressions each formed at a respective end of said first roller carrier which faces in a direction of movement of said guide, and two wedge-shaped bearing projections formed on said second roller carrier, each said projection engaging a respective depression in a direction transverse to the direction of guide; said first roller carrier is provided with two further V-shaped bearing depressions constituting its said receiving means; said typing element carrier is provided with two wedge-shaped bearing protrusions engaging in said two further V-shaped depressions; said second roller carrier is provided with a guide opening formed to define said slide edge; and said typing element carrier is provided with a supporting tongue inserted into said guide opening of said second roller carrier in a direction transverse to the direction of movement of said guide for effecting the connection between said second roller carrier and said typing element carrier.

3. An arrangement as defined in claim 1 wherein said typing element carrier is provided with a lever arm and a supporting tongue, and said tensioning spring means and said supporting spring means are together constituted by at least one unitary spring member engaging said second roller carrier and said lever arm for urging said rollers against said rails and for maintaining said tongue in contact with said slide edge.

4. An arrangement as defined in claim 3 wherein said spring member is essentially a U-shaped leaf spring provided at each of its ends with detent tongues extending transversely to the legs of the U shape, and said second roller carrier and said typing element carrier are each provided with a detent recess receiving a respective detent tongue.

5. An arrangement as defined in claim 4 wherein there are two said spring members and said second roller carrier and said typing element carrier are each provided with two such detent recesses located at opposite respective ends thereof, in the direction of movement of said guide, for receiving a respective detent tongue of a respective spring.

6. An arrangement as defined in claim 1 further comprising a plurality of shaft journals each supporting a respective guide roller and wherein each said roller carrier is provided with bearing depressions for receiving a respective journal and a detent tongue for retaining the respective journal in place.

7. An arrangement as defined in claim 1 wherein the guide is disposed in a machine frame having a recess bounded by parallel edges each provided with a depression in which a respective one of said rails is mounted, and further comprising at least one spreading ring engaging said rails outside of the region of movement of the guide for holding said rails in position in said depressions.

8. An arrangement as defined in claim 7 wherein said spreading ring is constituted by a sheet metal planar bar spring provided at one end with a holding jaw engaging one of said rails and open in the direction of mounting of said one rail in its associated depression, and at its other end with a jaw in the form of a retaining ring engaging the other one of said rails and open in the direction transverse to the direction of mounting of said other rail in its associated depression, and said guide rails are provided with annular grooves for receiving and axially securing the jaws.

9. An arrangement as defined in claim 8 wherein there are two of said spreader rings disposed at respectively opposite ends of said guide.

* * * * *